US006322263B1

(12) United States Patent
Niikura

(10) Patent No.: US 6,322,263 B1
(45) Date of Patent: Nov. 27, 2001

(54) PRINTING APPARATUS AND PRINTING CONTROL METHOD

(75) Inventor: Takeji Niikura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/512,361

(22) Filed: Feb. 24, 2000

(30) Foreign Application Priority Data

Feb. 24, 1999 (JP) ..... 11-047201

(51) Int. Cl.[7] ..... B41J 21/16; B41J 3/42
(52) U.S. Cl. ..... 400/279; 400/74; 400/283
(58) Field of Search ..... 400/279, 283, 400/74

(56) References Cited

U.S. PATENT DOCUMENTS

| | | | | |
|---|---|---|---|---|
| 3,925,787 | * | 12/1975 | Suzuki | 346/75 |
| 4,313,124 | | 1/1982 | Hara | 346/140 R |
| 4,345,262 | | 8/1982 | Shirato et al. | 346/140 R |
| 4,459,600 | | 7/1984 | Sato et al. | 346/140 R |
| 4,463,359 | | 7/1984 | Ayata et al. | 346/1.1 |
| 4,558,333 | | 12/1985 | Sugitani et al. | 346/140 R |
| 4,723,129 | | 2/1988 | Endo et al. | 346/1.1 |
| 4,740,696 | | 4/1988 | Osawa et al. | 250/288 |
| 4,740,796 | | 4/1988 | Endo et al. | 346/1.1 |
| 5,007,751 | * | 4/1991 | Yamakawa | 400/322 |
| 6,071,025 | * | 6/2000 | Shoki | 400/191 |
| 6,106,176 | * | 8/2000 | Yanagisawa et al. | 400/615.2 |
| 6,120,196 | * | 9/2000 | Matsuda | 400/55 |

FOREIGN PATENT DOCUMENTS

| | | |
|---|---|---|
| 54-56847 | 5/1979 | (JP) . |
| 59-123670 | 7/1984 | (JP) . |
| 59-138461 | 8/1984 | (JP) . |
| 60-71260 | 4/1985 | (JP) . |
| 9-118057 | 5/1997 | (JP) . |

* cited by examiner

*Primary Examiner*—John S. Hilten
*Assistant Examiner*—Charles H. Nolan, Jr.
(74) *Attorney, Agent, or Firm*—Fitzpatrick, Cella, Harper & Scinto

(57) ABSTRACT

Disclosed are a printing apparatus and a method of controlling printing through which highly precise printing can be performed without inviting an increase in production cost or in the size of the apparatus. In accordance with the control method, a printing starting position is decided based upon input print data whenever a printing medium undergoes one printing scan by a printhead. Whether or not the printing starting position decided falls within a predetermined range is discriminated. If it has been discriminated that the printing starting position falls within the predetermined range, the scanning starting position of the printhead scanned by the carriage is set to a position spaced a predetermined first distance away from one end of a range within which printing can be performed on the printing medium. If it has been discriminated that the printing starting position falls outside the predetermined range, the scanning starting position of the printhead is set to a position spaced a predetermined second distance away from the printing starting position. After the carriage to which the printhead is mounted has been moved to the set position, printing is performed by moving the carriage.

13 Claims, 10 Drawing Sheets

FIG. 8

| PRINTHEAD / PRINTING MODE | MONOCHROME | COLOR | PHOTOGRAPHIC |
|---|---|---|---|
| HQ, Fine | MEDIUM SPEED | MEDIUM SPEED | — |
| HS | HIGH SPEED | HIGH SPEED | — |
| SMOOTHING | LOW SPEED | — | — |
| PHOTOGRAPHIC | — | — | LOW SPEED |

PRINTING APPARATUS AND PRINTING CONTROL METHOD

FIELD OF THE INVENTION

This invention relates to a printing apparatus and to a printing control method. More particularly, the invention relates to printing apparatus and printing control method for forming an image by scanning a carriage on which a printhead is mounted.

BACKGROUND OF THE INVENTION

A printing apparatus used as the printing section of a printer, copier or facsimile machine or a printing apparatus used as the output unit of a multifunction electronic device, which includes a computer or word processor, or of a work station is adapted to print an image on a printing medium such as printing paper or thin plastic sheet based upon image information. Such printing apparatus can be classified according to their printing methods, e.g., ink-jet printers, wire-dot printers, thermal printers and laser printers, etc.

In a serial-type printing apparatus in which an image is printed on a printing medium by moving a printhead back and forth in a direction (referred to as the "main scan direction") that intersects the direction in which the printing medium is conveyed (this direction is referred to as the "sub-scan direction"), printing is performed over the entire printing medium by repeating an operation which includes printing an image by the printhead mounted on a carriage, conveying the printing medium a predetermined amount whenever the printing of one scan (one line) is completed and then printing the next line of the image on the printing medium whose conveyance has been halted.

FIG. 9 is a diagram illustrating an example of printing position precision produced when a printhead has printed a given line (where a dot is printed every 1/90 of a pitch and the deviation is measured).

In FIG. 9, the horizontal axis indicates the positions of printed dots, in which the position at which printing starts is taken as the starting point. The vertical axis indicates cumulative amount of deviation from a position at which printing was supposed to have been performed. The positive side of the vertical axis indicates deviation in a direction away from the home position of the printhead, where the position at which printing is supposed to be performed is taken as zero, and the negative side indicates deviation in a direction toward the home position.

Since printing usually starts after the carriage motor has attained a constant speed, the carriage motor starts being driven somewhat short of the position at which printing is to start, thereby moving the carriage. Accordingly, as will be understood from FIG. 9, printing precision is somewhat poor immediately after start-up of the carriage motor that drives the carriage (i.e., in the vicinity of the printing starting point), and the deviation in the printing position at this time is ±40–50 $\mu$m. The printing position subsequently stabilizes and the amount of deviation becomes ±10–20 $\mu$m.

Accordingly, in a case where staircase-like ruled lines of the kind shown in FIG. 10, for example, are printed on a printing medium P, the printing starting position differs for each scan of the printhead and the position at which the carriage motor is driven changes little by little at the locations of the steps of the ruled lines. As a consequence, the position at which movement of the carriage starts shifts from that of the preceding line of scanning.

This will be described with reference to FIG. 9.

The curved formed by the black dots in FIG. 9 indicates the change in amount of deviation of printing position produced on a given line in a case where staircase-shaped ruled lines are printed. The curve indicating the phantom line represents the change in amount of deviation of printing position produced on the immediately preceding line in printing of the staircase-shaped ruled lines. The reason why the curve indicated by the phantom line starts from an area on the negative side of the horizontal axis is that the printing starting point on the curve formed by the black dots is taken as the starting point and the staircase ruled line of the preceding line is shifted to the left side by an amount equivalent to this step of the staircase.

In any case, when a staircase-shaped ruled line is printed in this fashion, there are instances where a maximum deviation of 70 $\mu$m occurs between neighboring printed lines.

Such deviation becomes conspicuous where the ruled lines join, namely at positions a, b, c and d in FIG. 10, and causes a decline in the image quality of the printed image.

In a printing apparatus that forms the color black by superimposed printing of printing materials of multiple colors Y (yellow), M (magenta) and C (cyan), the above-mentioned deviation is a cause of color offset and results in a marked decline in image quality.

As arrangement has been proposed in order to solve this problem. For example, as described in the specification of Japanese Patent Publication Laid-Open No. 9-118057, each scanning starting position of a carriage is adjusted so as to take on a distance that is an integral multiple of distance the carriage is moved by rotation of a stepping motor resulting from one cycle of the excitation phase of the motor. The purpose of this is to eliminate a variance in printing position at the start of printing.

However, except for instances where cogging of the carriage motor is pronounced, vibration of mechanical portions is dominant in terms of amount of deviation from the absolute position of the printing starting point shown in FIG. 9. This makes necessary measures for dealing with vibration. Such vibration exhibits a characteristic period.

Measures for dealing with this problem in the prior art as indicated below.

(1) An encoder is mounted on the printing apparatus and the absolute position of the carriage is detected to assure precision in terms of the positions at which the dots of an image are formed.

(2) Since the carriage often is driven using a stepping motor, initially the motor is started up at low rpm and is accelerated to a prescribed usable rpm. After the motor attains this rotational speed, printing is carried out. If the carriage is subsequently stopped, rotation of the motor is slowed down from the usual rpm and is halted once the low rotational speed is attained. Lengthening distance at start-up of the motor reduces a fluctuation in carriage speed at the rpm used in printing and assures precision at which dots are formed into an image.

With the examples of the prior art mentioned above, however, extra components such as the encoder are required, thereby raising equipment cost. Further, lengthening distance at motor start-up leads to a reduction in effective printing length or, if a satisfactory printing length is maintained, to an increase in the size of the apparatus per se.

SUMMARY OF THE INVENTION

Accordingly, an object of the present invention is to provide a printing apparatus and printing control method through which highly precise printing can be performed without inviting an increase in production cost or in the size of the apparatus.

According to the present invention, the foregoing object is attained by providing a printing apparatus for forming an image on a printing medium by using a printhead comprising: scanning means on which the printhead is mounted for scanning the printhead back and forth in a first direction; conveyance means for conveying the printing medium in a second direction that intersects the first direction; input means for inputting print data; decision means for deciding a printing starting position whenever the printing medium undergoes one printing scan by the printhead, on the basis of the print data that has been input from the input means; discrimination means for discriminating whether or not the printing starting position decided by the decision means falls within a predetermined range; setting means for, on the basis of the discrimination made by the discrimination means, setting a scanning starting position of the printhead scanned by the scanning means, to a position spaced a predetermined first distance away from one end of a printable range on the printing medium if the printing starting position has been determined to fall within the predetermined range, while setting the scanning starting position of the printhead to a position spaced a predetermined second distance away from the printing starting position if the printing starting position has been determined to fall outside the predetermined range; and printing means for performing printing by moving the printhead after the printhead has been moved to the position set by the setting means.

The scanning means includes a carriage to which the printhead is mounted, and a carriage motor for generating a driving force that drives the carriage. In particular, the carriage motor is ideally a stepping motor.

It is preferred that the printhead be removably attachable to the scanning means, and that the printhead be selected from printheads of a plurality of types and removably attached to the scanning means. In this case the printheads of the plurality of types include a printhead for monochrome printing, a printhead for color printing and a printhead for photographic printing.

The printhead is preferably an ink-jet printhead for printing by discharging ink. Furthermore, it is preferred that the printhead have an electrothermal transducer for generating thermal energy applied to ink in order to discharge the ink by utilizing the thermal energy.

Furthermore, it is preferred that a plurality of selectable printing modes be provided for corresponding ones of the printheads of the plurality of types. In such case it is preferred that the setting means be capable of operating with respect to a specific printing mode among the plurality of printing modes.

Further, it is preferred that a table for setting the predetermined first and second distances be provided.

According to another aspect of the present invention, the foregoing object is attained by providing a printing control method applied to a printing apparatus for forming an image on a printing medium by using a printhead and having a carriage on which the printhead is mounted for scanning the printhead back and forth in a predetermined direction, the method comprising: an input step of inputting print data; a decision step of deciding a printing starting position whenever the printing medium undergoes one printing scan by the printhead, based upon the print data that has been input at the input step; a discrimination step of discriminating whether or not the printing starting position decided at the decision step falls within a predetermined range; a setting step of, on the basis of the discrimination made at the discrimination step, setting a scanning starting position of the printhead scanned by the carriage, to a position spaced a predetermined first distance away from one end of a printable range on the printing medium if the printing starting position has been determined to fall within the predetermined range, while setting the scanning starting position of the printhead to a position spaced a predetermined second distance away from the printing starting position if the printing starting position has been determined to fall outside the predetermined range; and a printing step of performing printing by moving the carriage, on which the printhead has been mounted, after the carriage has been moved to the position set at the setting step.

In accordance with the present invention as described above, a printing apparatus for forming an image on a printing medium by using a printhead has a carriage on which the printhead is mounted for scanning the printhead back and forth in a predetermined direction. On the basis of inputted print data, a printing starting position is decided whenever the printing medium undergoes one printing scan by the printhead. Whether or not the printing starting position decided falls within a predetermined range is discriminated. If it has been discriminated that the printing starting position falls within the predetermined range, the scanning starting position of the printhead scanned by the carriage is set to a position spaced a predetermined first distance away from one end of a range within which printing can be performed on the printing medium. If it has been discriminated that the printing starting position falls outside the predetermined range, the scanning starting position of the printhead is set to a position spaced a predetermined second distance away from the printing starting position. After the carriage to which the printhead is mounted has been moved to the set position, printing is performed by moving the carriage.

The invention is particularly advantageous since even if the carriage develops a fluctuation in speed, a deviation between neighboring dots of an image formed by scanning the printhead is suppressed so that a high-definition image can be formed.

Further, equipment cost can be reduced because the present invention does not require means for measuring the carriage position such as an encoder or high-resolution motor.

Furthermore, the shifting of the scanning starting position of the printhead to the position spaced the prescribed second distance from the printing starting position is performed only in a case where the printing starting position falls outside the predetermined range. As a result, lengthening of the range of movement of the carriage is prevented and there is no increase in the size of the apparatus.

Other features and advantages of the present invention will be apparent from the following description taken in conjunction with the accompanying drawings, in which like reference characters designate thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 8 is a table showing the relationship between usable printheads and printing modes that can be supported by these printheads;

DESCRIPTION OF THE PREFERRED EMBODIMENTS

A preferred embodiment of the present invention will now be described in detail with reference to the accompanying drawings.

Figure 1:
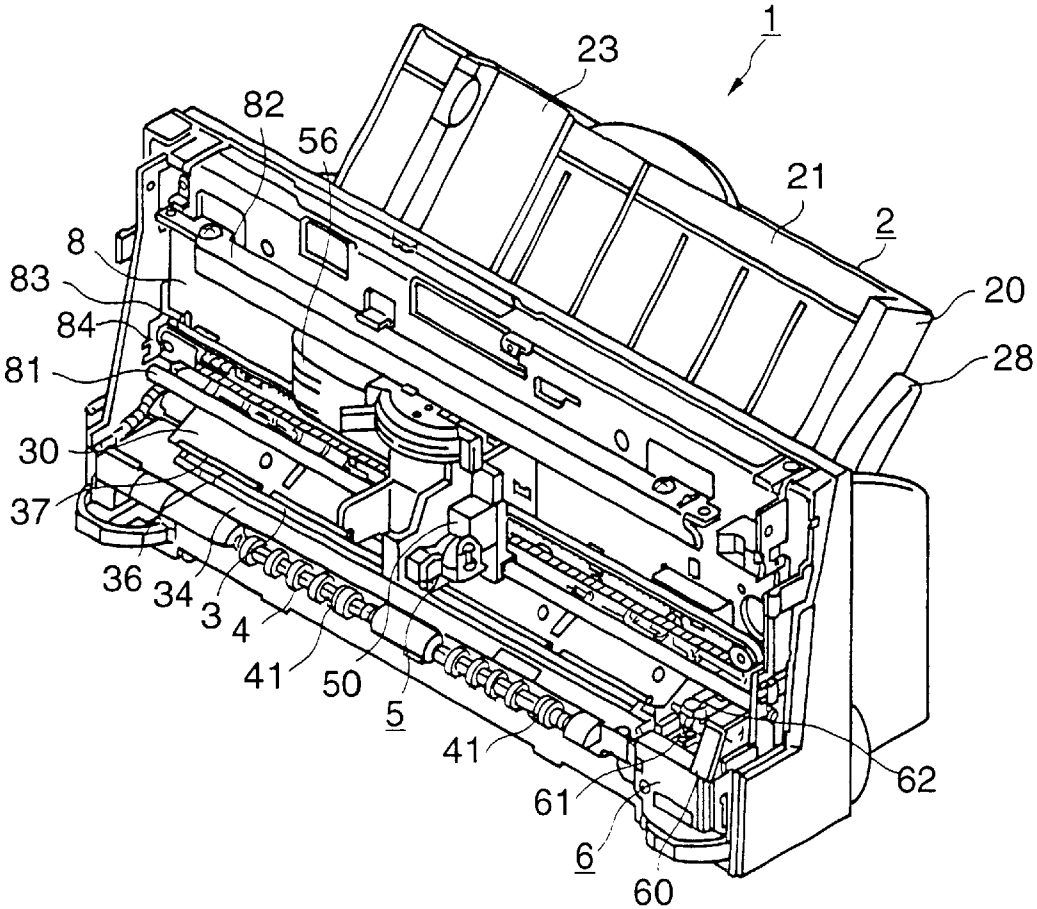
FIG. 1 an external perspective view showing the overall structure of a printing apparatus, according to a typical embodiment of the present invention, which performs printing in accordance with the ink-jet printing method.
Figure 2:
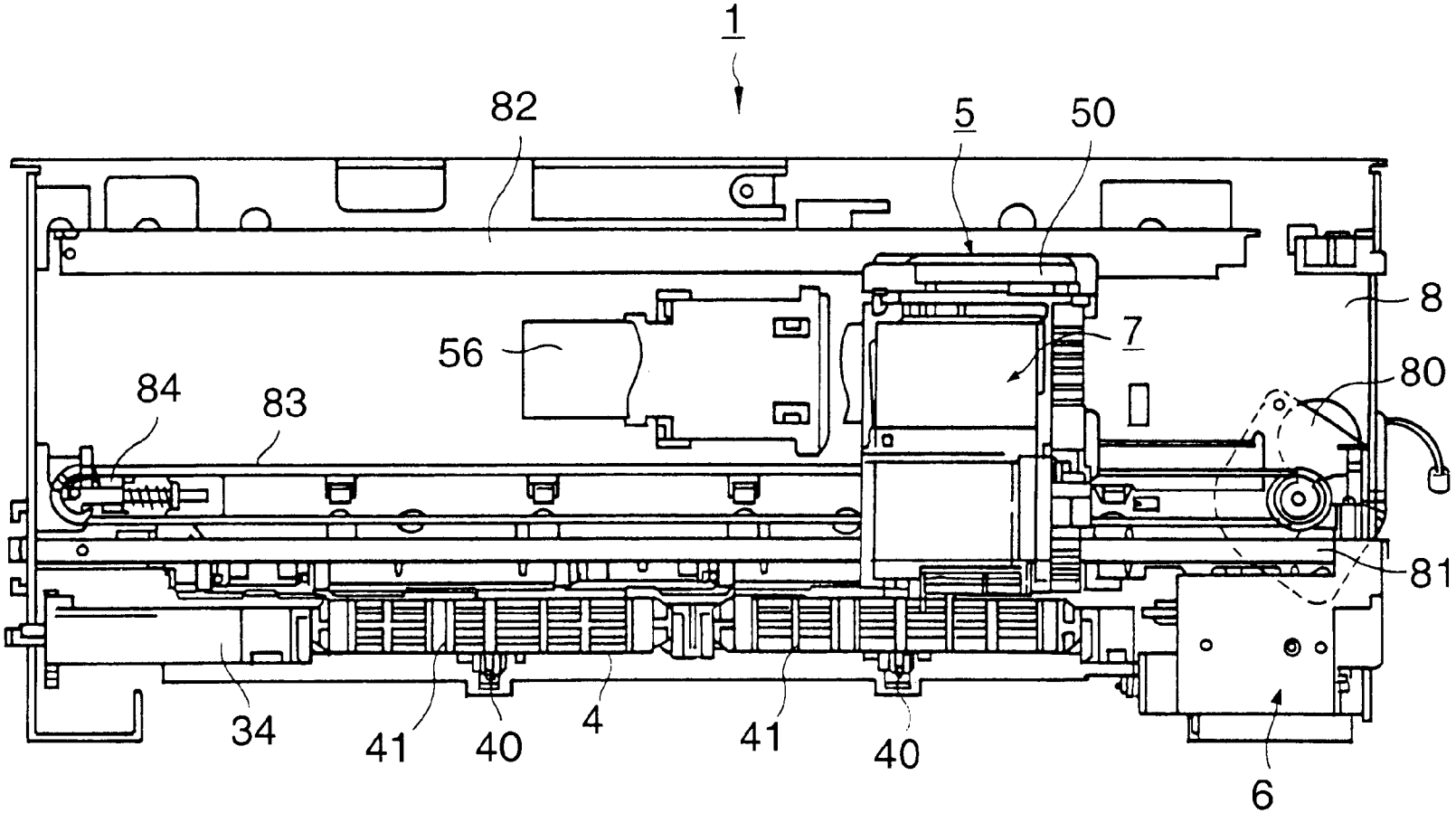
FIG. 2 is a front view of the printing apparatus depicted in FIG. 1.
Figure 3:
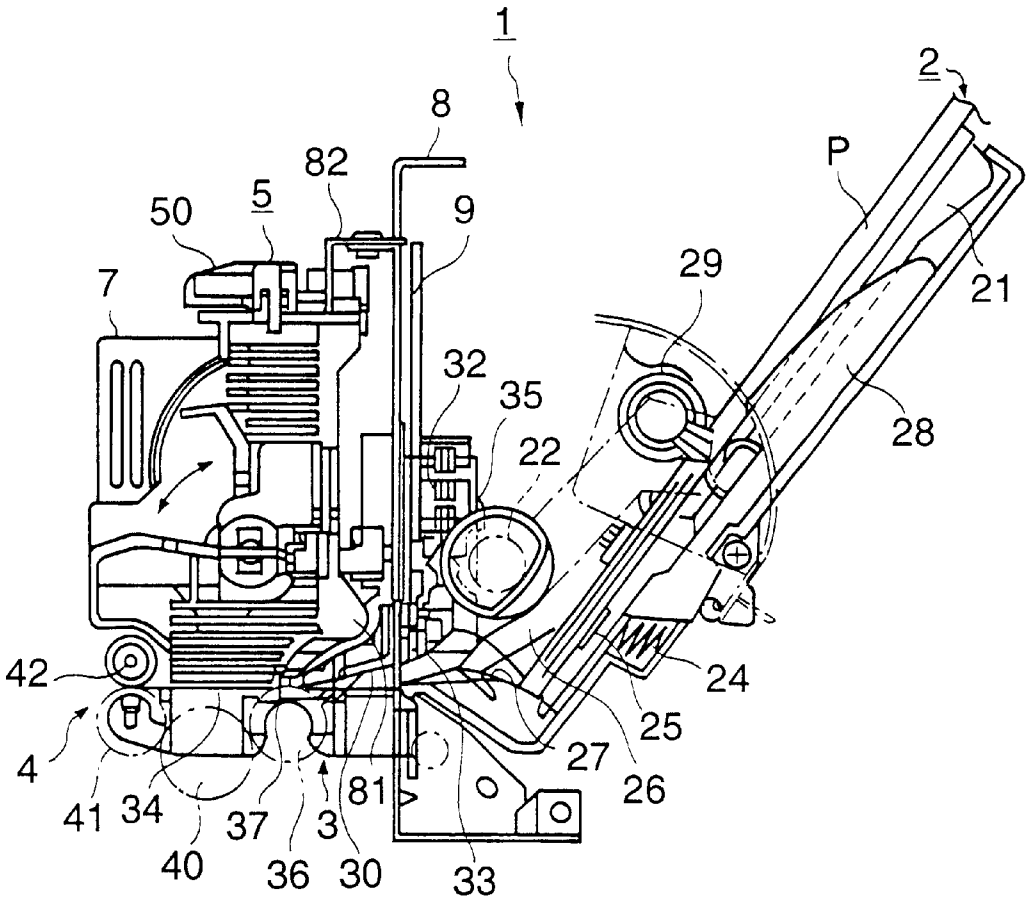
FIG. 3 is a side sectional view of the printing apparatus depicted in FIG. 1.

FIGS. 1 to 3 illustrate a printing apparatus, according to a typical embodiment of the present invention, in which a printhead which performs printing in accordance with the ink-jet method is mounted on a carriage and the carriage is scanned serially to print on a printing medium. The printing apparatus uses a stepping motor as a carriage motor serving as the driving source for scanning the carriage, on which the printhead is mounted, back and forth. The printing apparatus is further provided with an automatic sheet feeder (ASF) for feeding a printing medium such as printing paper automatically.

FIGS. 1 to 3 are an external perspective view showing the overall structure of a printing apparatus 1, a front view of the printing apparatus 1 and a side view of the printing apparatus 1, respectively.

The printing apparatus 1 can be broadly divided into a paper feed section 2, a paper conveyance section 3, a paper ejection section 4, a carriage section 5 and a cleaning section 6. The various components of these sections will be described successively below with reference to FIGS. 1 to 3.

<Paper Feed Section>

The paper feed section 2 includes a base 20 to which are attached a pressure plate 21 on which sheets of a printing medium (referred to as printing sheets P below) are stacked, and a feeding rotary body 22 for feeding the printing sheets P. The pressure plate 21 is movably provided with a movable side guide 23, which decides the stacking position of the printing sheets P. The pressure plate 21 is capable of rotating about a rotary shaft connected to the base 20 and is urged against the feeding rotary body 22 by a pressure-plate spring 24. Provided on the pressure plate 21 where it opposes the feeding rotary body 22 is a separation pad 25, which consists of a material such as artificial leather having a large coefficient of friction that prevents more than one printing sheet P from being fed at a time. The base 20 is further provided with a separation member 26 which covers the corners of a printing sheet P in one direction to separate the printing sheets P one sheet at a time, and with an embankment formed integral with the base 20 to separate thick sheets of paper or the like for which the separation member cannot be used. The separation member 26 acts in an ordinary-paper position. The base 20 is further provided with a changeover level 28 which, in a thick-paper position, is changed over so that the separation member 26 will not operate, and with a release cam 29 for eliminating contact between the pressure plate 21 and the feeding rotary body 22.

When the apparatus described above is in the standby state, the release cam 29 pushes the pressure plate 21 downward to a predetermined position. As a result, the pressure plate 21 and the feeding rotary body 22 are taken out of contact. If the driving force possessed by a conveyance roller 36 is transmitted to the feeding rotary body 22 and release cam 29 by gears under these conditions, the release cam 29 separates from the pressure plate 21. As a result, the pressure plate 21 rises, a printing sheet P makes contact with the feeding rotary body 22 and, as the feeding rotary body 22 rotates, the printing sheet P is picked up and starts being fed. The printing sheets P are separated one sheet at a time by the separation member 26 and fed to the paper conveyance section 3. The feeding rotary body 22 and release cam 29 rotate until the printing sheet P is fed into the paper conveyance section 3. At this time the standby state in which the printing sheets P and feeding rotary body 22 are taken out of contact is attained again and the driving force from the conveyance roller 36 stops being transmitted.

<Paper Conveyance Section>

The paper conveyance section 3 has the conveyance roller 36 for conveying the printing sheets P, and a PE sensor 32. The conveyance roller 36 is provided with an abutting pinch roller 37 that follows up rotation of the conveyance roller 36. The pinch roller 37 is held by a pinch-roller guide 30 and is biased by pinch-roller spring (not shown) so that the pinch roller 37 is brought into pressured contact with the conveyance roller 36 to produce a force that conveys the printing sheets P. Furthermore, an upper guide 33 for guiding the printing sheets P and a platen 34 are disposed at the entrance to the paper conveyance section 3 to which the printing sheets P are fed. The upper guide 33 is provided with a PE sensor lever 35 for transmitting detection of leading and trailing edges of a sheet P to the PE sensor 32. A printhead 7 for forming images based upon image information is provided downstream of the conveyance roller 36 in terms of the direction in which the printing sheets are conveyed.

In the arrangement described above, the printing sheets P fed to the paper conveyance section 3 are sent to a pair of rollers composed of the conveyance roller 36 and pinch roller 37 while being guided by platen 34, pinch-roller guide 30 and upper guide 33. At this time the leading edge of a conveyed sheet P is sensed by the PE sensor lever 35, whereby the printing position of the printing sheets P is obtained. Further, the printing sheets P are conveyed on the platen 34 by rotation of the pair of the rollers 36 and 37, which are rotated by a line-feed (LF) motor (not shown).

A readily replaceable ink-jet printhead constructed as an integral part of an ink tank is used as the printhead 7. The printhead 7 is capable of applying heat to ink by means of a heater or the like. The heat causes the ink to undergo film boiling. The ink is discharged from nozzles of the printhead 7 by a change in pressure caused by growth or shrinkage of air bubbles resulting from film boiling. The discharged ink forms an image on the printing sheets P.

<Carriage Section>

The carriage section 5 has a carriage 50 to which the printhead 7 is attached. The carriage 50 is supported by a guide shaft 81 for scanning the carriage back and forth at right angles to the direction in which the printing sheets P are conveyed, and by a guide rail 82 which holds the rear end of the carriage 50 to maintain a clearance between the printhead 7 and the printing sheets P. The guide shaft 81 and guide rail 82 are attached to a chassis 8. The carriage 50 is driven by a carriage motor 80, which is mounted on the chassis 8, via a timing belt 83. The timing belt 83 is tensioned and supported by an idle pulley 84. Furthermore, the carriage 50 has a flexible circuit board 56 for transmitting a head signal from an electrical substrate 9 to the printhead 7.

When an image is formed on a printing sheet P in the above-described arrangement, the pair of rollers 36 and 37 conveys the printing sheet P to the line position at which the image is to be formed (this position being in the direction in which the printing sheet P is conveyed), and the carriage 50 is moved by the carriage motor 80 to the column position at which the image is to be formed (this position being in the direction perpendicular to that in which the printing sheet P is conveyed), whereby the printhead 7 is made to oppose the image formation position. The printhead 7 is thenceforth caused to discharge ink toward the printing sheet P in response to a signal from the electrical substrate 9, thereby forming an image on the sheet.

<Paper Ejection Section>

The paper ejection section 4 has a transfer roller 40 in abutting contact with the conveyance roller 36 and with a paper-ejection roller 41. Accordingly, the driving force of the conveyance roller 36 is transmitted to the paper-ejection roller 41 via the transfer roller 40. Further, a spur 42 capable of rotating while following up the paper-ejection roller 41 is in abutting contact with the paper-ejection roller 41.

By virtue of this arrangement, a printing sheet P on which an image has been formed by the carriage section 5 is clamped at the nip between the paper-ejection roller 41 and spur 42 and is conveyed so as to be ejected into a discharged tray (not shown) or the like.

<Cleaning Section>

The cleaning section 6 comprises a pump 60 for cleaning the printhead 7, a cap 61 for suppressing drying of the printhead 7, and a drive-changeover arm 62 for switching over the driving force of the conveyance roller 36 to the paper feed section 2 and pump 60. At times other than that of the paper feed and cleaning operations, the drive-changeover arm 62 does not transfer driving force to the paper feed section 2 and pump 60 because a planetary gear (not shown), which rotates about the conveyance roller 36, is fixed at a predetermined position. When the drive-changeover arm 62 is moved owing to movement of the carriage 50, the planetary gear is freed and therefore moves in conformity with the direction (forward or reverse) in which the conveyance roller 36 rotates. Driving force is transferred to the paper feed section 2 when the conveyance roller 36 rotates in the forward direction and to the pump 60 when the conveyance roller 36 rotates in the reverse direction.

A method of driving the stepping motor used to drive the carriage section 5 in this embodiment will now be described.

Figure 4:
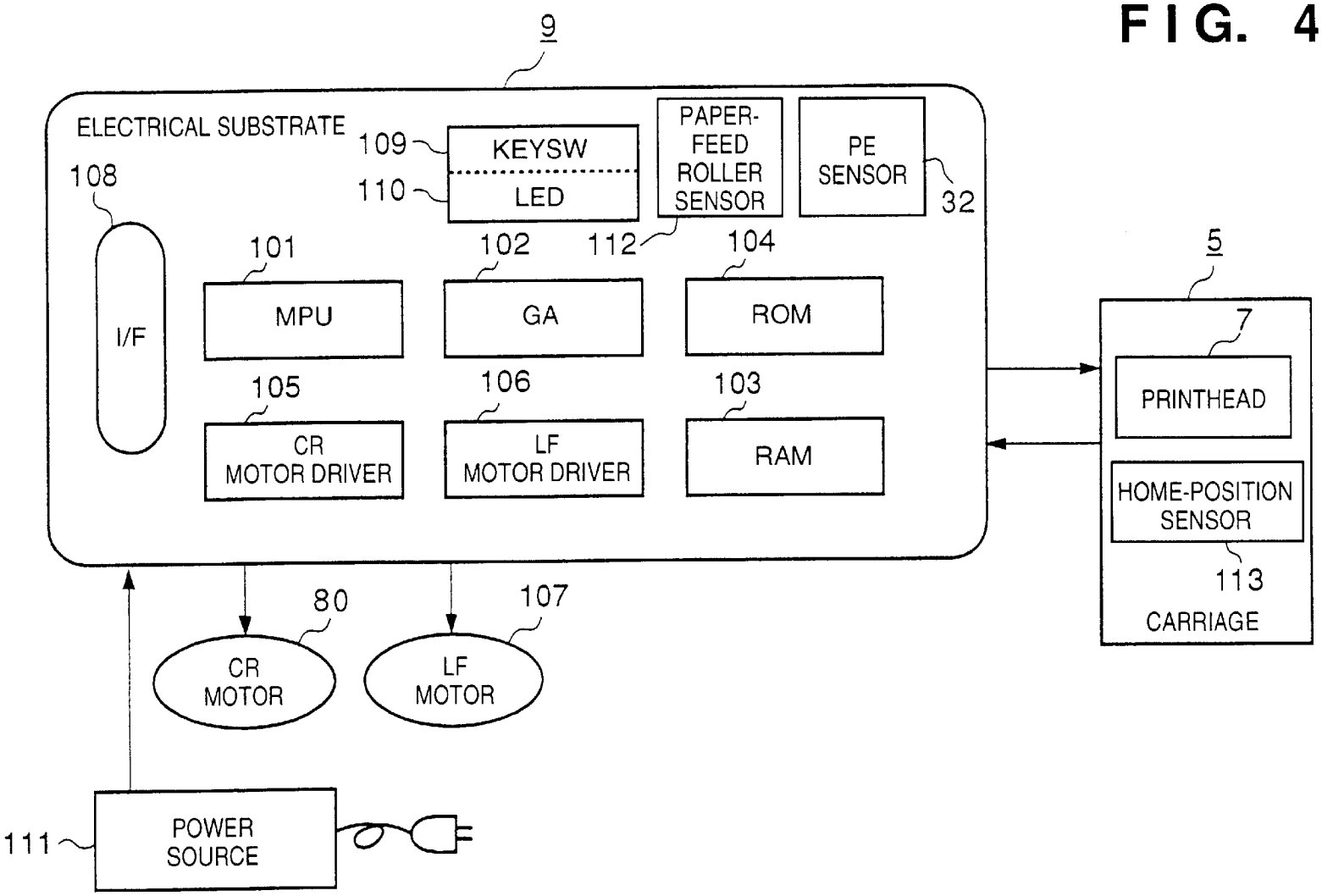
FIG. 4 is a block diagram showing the construction of a control circuit in the printing apparatus depicted in FIG. 1.

FIG. 4 is a block diagram showing the construction of a control circuit for controlling the printing apparatus 1.

As shown in FIG. 4, numeral 101 denotes an MPU for controlling motor drive and the printing operation; 102: a gate array (GA); 103: a DRAM; 104: a ROM; 105: a carriage motor driver; 106: a conveyance (line-feed) motor driver; 107: a conveyance (LF) motor; 108: an interface (I/F) which interfaces a host computer, for receiving print data from the host computer; 109: a key switch (KEYSW) by which the user of the apparatus makes various commands; 110: an LED lamp for informing the user of the status of the apparatus; 112: a paper-feed roller sensor for supporting the functions of the ADF function; and 80: a carriage (CR) motor.

Further, the carriage section 5 is provided with a home-position sensor 113 for sensing the home position of the carriage.

The control circuit described above operates on power supplied from a power source 111.

The carriage motor driver 105 uses a driver of constant-current bipolar chopping type. A signal is sent to the carriage motor driver 105 by the MPU 101 in accordance with the set parameters of the driving frequency of the carriage motor 80 and constant current so as to drive the CR motor 80. The carriage motor 80 is a PM-type stepping motor having a resolution of 96 steps of $\phi$42. Ferrite is used as magnetic body of the rotor.

The stepping motor is driven by two phases and the number of applied pulses needed to start up the motor is 36. The starting pulse frequency is about 100 pps, and a prescribed constant-speed frequency is about 1000 pps. A ramp-up driving curve forms an S-shaped curve which connects the inflection points of a cubic curve and starts up by the prescribed constant-speed frequency of about 1000 pps. A ramp-down driving curve is substantially symmetrical to the ramp-up driving curve.

Figure 5:
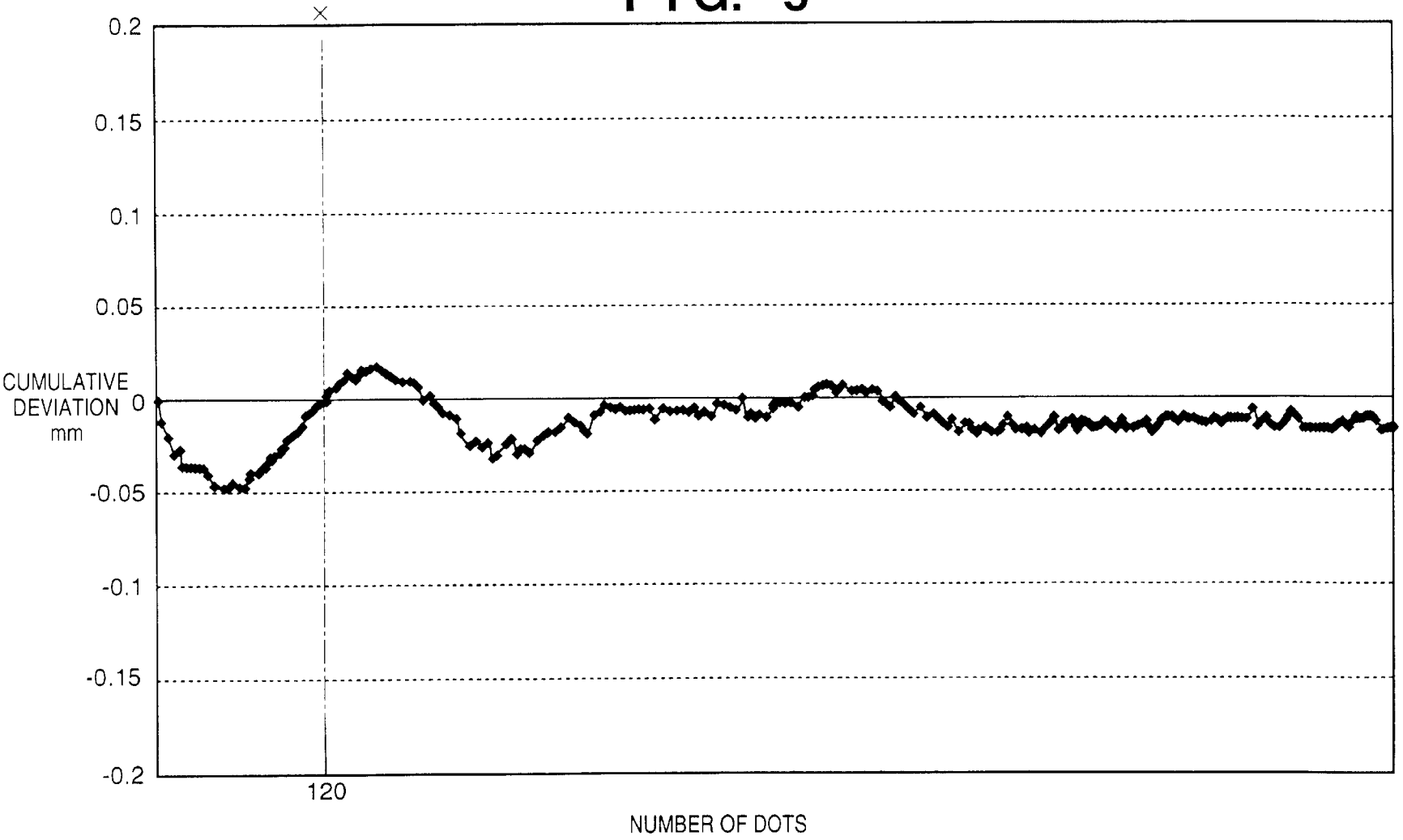
FIG. 5 is a diagram showing an example of printing position precision produced when a printhead performs printing.

FIG. 5 is a diagram illustrating an example of printing position precision produced when printing is performed by the printhead 7 (where a dot is printed every 1/90 of a pitch and the deviation is measured).

Though there is some difference from one apparatus to another, the printing position precision in this case declines somewhat immediately after the carriage motor 80 is started up, as shown in FIG. 5, and the deviation in printing position at this time is ±40–50 $\mu$m. After this, since cumulative amount of deviation shows a variation like attenuational vibration, stabilization is achieved, and the deviation becomes ±10–20 $\mu$m. This tendency of printing precision is maintained even though the line undergoing scanning for printing changes. Accordingly, if an image in which the edges of printing are in line on the printing medium is printed, the starting positions of the carriage 50 also are in line. In this case, even though the printing precision immediately after start-up of the carriage motor 80 declines somewhat, the printed dots deviate in a manner similar to that when the preceding line was scanned. As a consequence, this deviation is not noticeable as an image.

Figure 6:
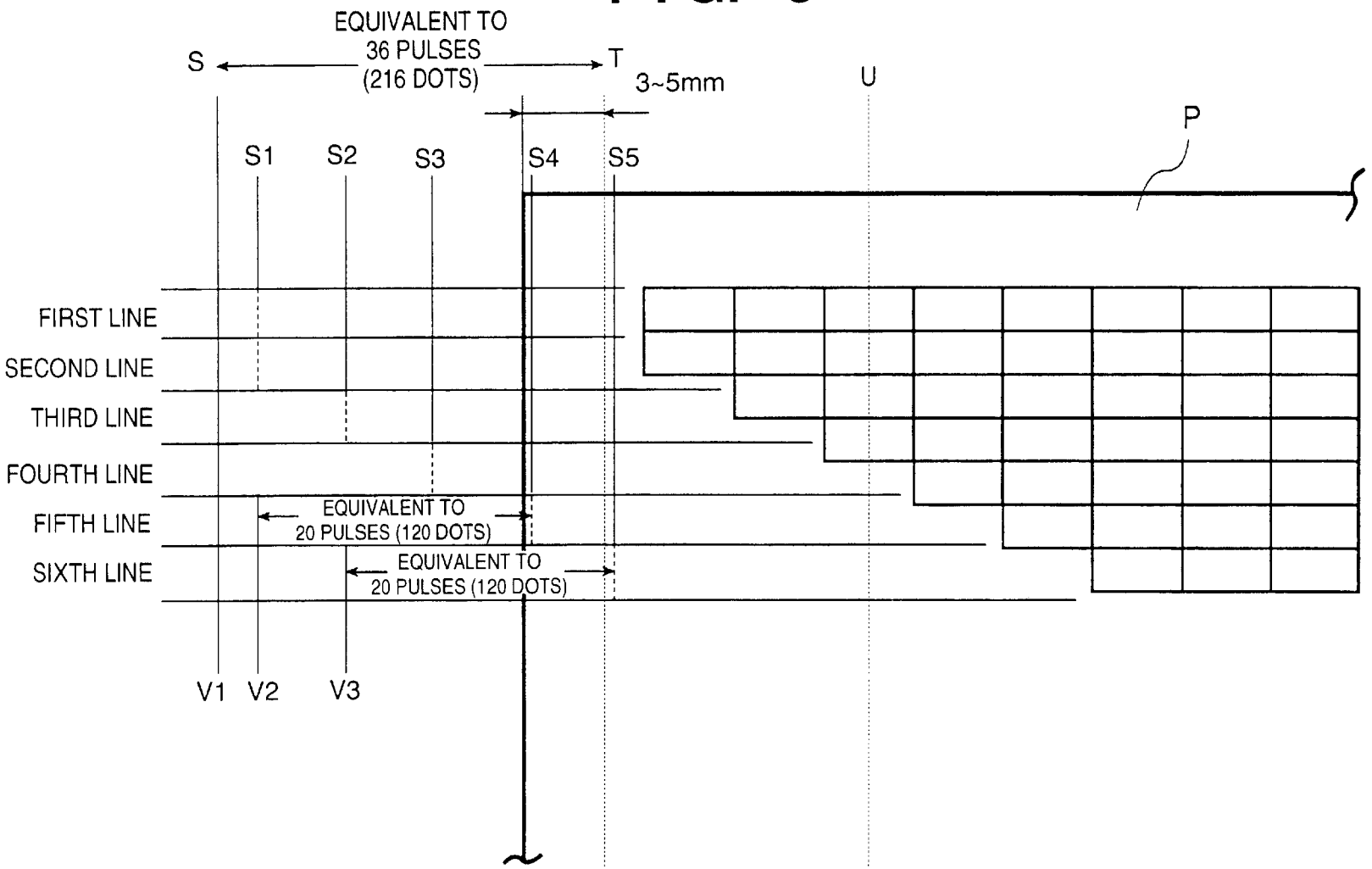
FIG. 6 is a diagram showing an instance where staircase-shaped ruled lines are printing on a printing sheet P.

FIG. 6 illustrates the manner in which staircase-like ruled lines are printed on a printing sheet P.

Figure 10:
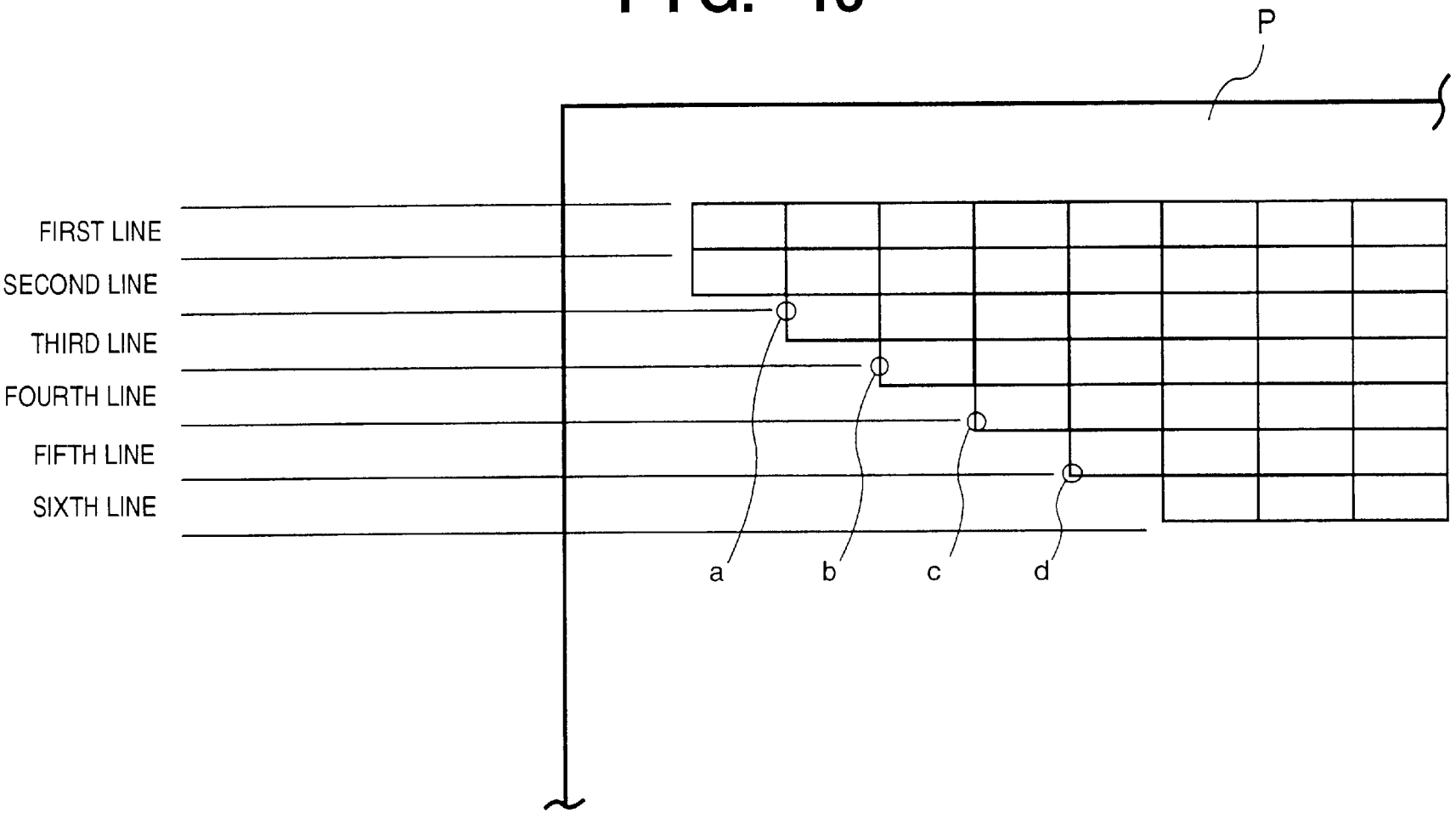
FIG. 10 is a diagram describing deviation of printed dots in an instance where staircase-shaped ruled lines are printing on a printing medium P.

As described also in regard to the example of the prior art, the point at which the carriage 50 starts moving shifts for each printed line when staircase ruled lines of the kind shown in FIG. 6 are printed. In this case, there are instances where a maximum deviation of 70–80 $\mu$m in printing position occurs between neighboring printed lines, as described earlier with reference to FIG. 10 concerning an example of the prior art. This deviation causes a shift in ruled lines, particularly in a case where staircase-shaped ruled lines are printed. It also causes printing unevenness when printing is performed at high resolutions. The prime factor behind this deterioration in printing precision is a fluctuation in speed caused by vibration of mechanical portions, which include the carriage motor 80, as pointed out earlier in the description of the prior art. In the mechanism, attenuational vibration possesses a substantially constant period.

In this embodiment, printing control of the kind illustrated below is carried out to solve this problem.

Assume that the printhead 7 is a 64-nozzle monochrome head having a resolution of 360 dpi. Further, assume that the stepping motor used as the carriage motor 80 is capable of moving the carriage 50 a distance for printing six dots of an image per driving pulse. An example will be described in which staircase-like ruled lines that descend from left to right are formed while a printing sheet P is printed on in one direction, namely from left to right, as depicted in FIG. 6.

In FIG. 6, P represents the printing medium and T the left end of the printable range, which usually is set to 3–5 mm from the edge of the printing medium. Further, S represents the position at which movement of the carriage 50 starts in a case where printing is performed from the left end T of the printable range. The distance between S and T is that traversed by the carriage 50 in response to 36 driving pulses applied to the stepping motor (this distance corresponds to 216 dots in terms of printed dots).

The cleaning section is provided outwardly of the position S (namely on the side of S that is opposite to T). If the position of S were shifted to the side of the cleaning section, this would enlarge the size of the apparatus. Further, in this embodiment, U which is a reference position where a control sequence is switched over is a position at a distance from T that corresponds to 20 driving pulses of the stepping motor (this distance corresponds to 120 dots in terms of printed dots).

Note that the reason why U is set to be a position at a distance from T corresponding to 20 driving pulses (corresponds to 120 dots) is to take into account a great amount of deviation immediately after starting movement of the carriage, and U is determined based on a position (the first node in a vibration curve showing cumulative amount of deviation in FIG. 5) where the vibration curve intersects "zero" line of the cumulative amount of deviation for the first time.

Upon determining a reference position (U), U is not limited to a number of pulses corresponding to the first node in the vibration curve. U may be determined based on a position corresponding to the second node, which indicates the end of one period of the vibration curve, or another position corresponding to a higher node.

In this case, if the value of U is determined to be greater, since printing can starts after the amount of deviation becomes lesser, the printed image quality is greatly improved. This is an advantage. However, the greater value of U results in quite often moving the carriage back to the left end of the carriage movable range. This is a disadvantage since printing time increases. Thus, it is desirable to consider the advantage and disadvantage upon determining the value of U.

If printing is performed in accordance with the example of the prior art under the above-described conditions, the first and second lines of printing by the printhead start from S1, the third line starts from S2, the fourth line starts from S3, the fifth line tarts from S4 and the sixth line starts from S5, and there is a possibility that a deviation in the portions at which the ruled lines join will occur, as mentioned earlier.

Figure 7:
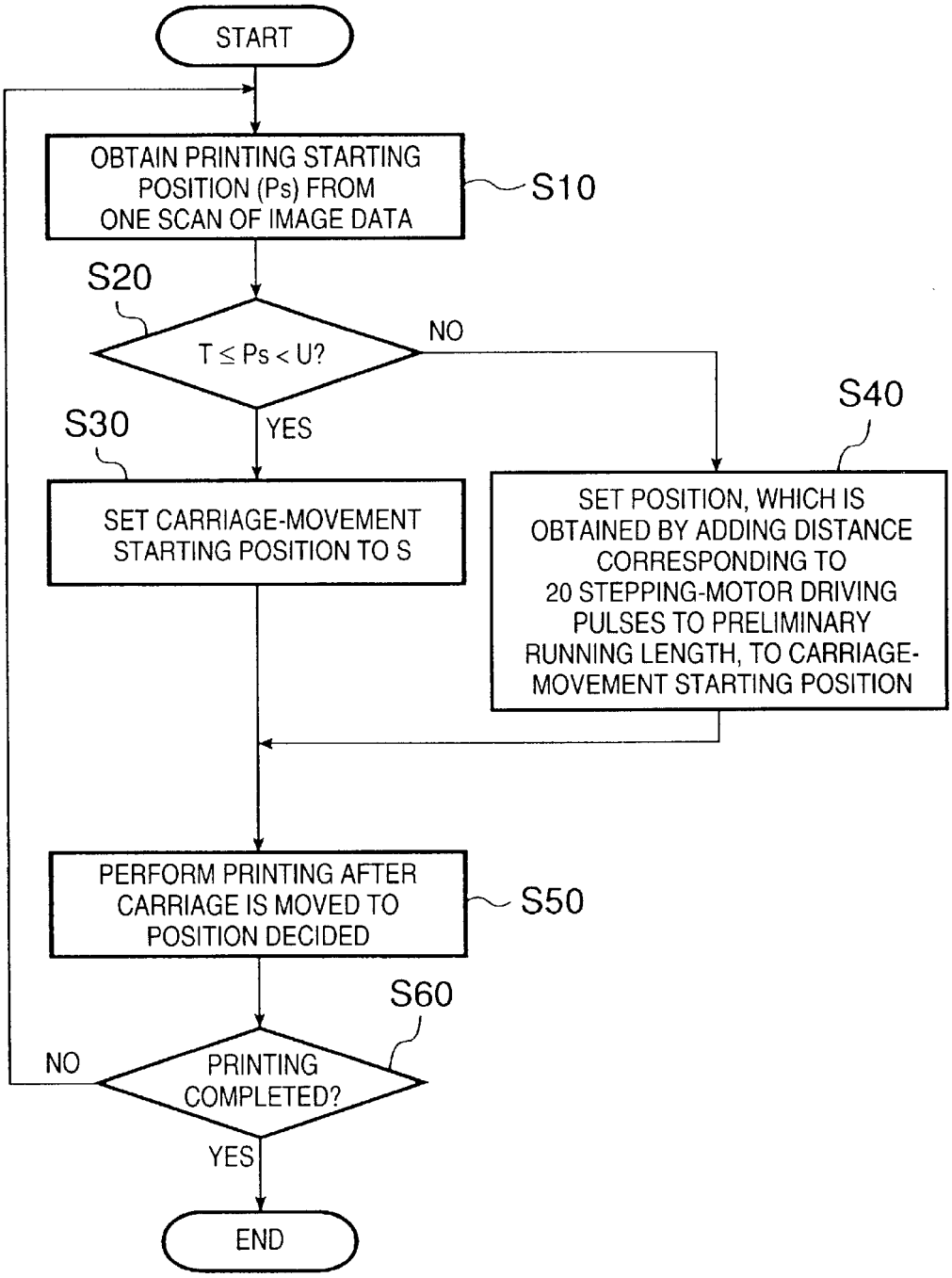
FIG. 7 is a flowchart illustrating processing for controlling printing.
Figure 9:
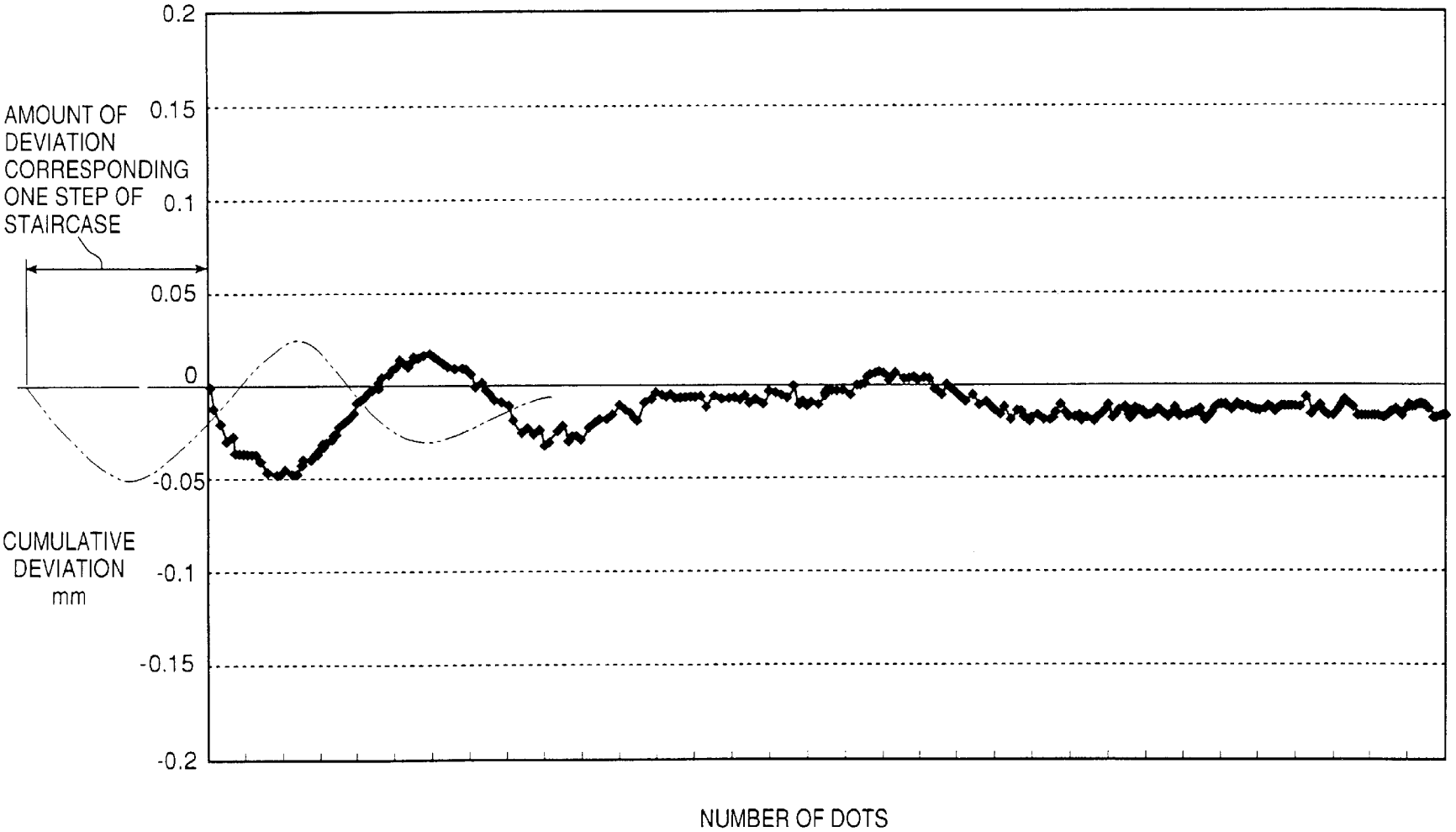
FIG. 9 is a diagram showing an example of printing position precision produced when a printhead has printed a given line (where a dot is printed every 1/90 of a pitch and the deviation is measured)

By contrast, in accordance with the present invention, deviation of the printed dots is suppressed by executing processing for printing control illustrated in the flowchart of FIG. 7.

First, at step S10, a printing starting position (Ps) is obtained from a single scan of print data. Next, at step S20, it is determined whether the position obtained at step S10 lies between T and U.

If $T \leqq P_s < U$ is found to hold, control proceeds to step S30, at which the position at which the carriage starts being moved is set to S. If $U \leqq P_s$ is found to hold, on the other hand, control proceeds to step S40. Here the position at which the carriage starts being moved is shifted leftward, by a distance (which is determined by the same reason as determining the position of U) that corresponds to 20 driving pulses (120 printed dots) applied to the stepping motor, from the carriage starting position (S1, S2, S3, S4 and S5, etc., in FIG. 6) decided from a preliminary running length (which is a distance necessary to accelerate the carriage and equivalent to 36 driving pulses applied to the stepping motor) of the carriage, which has been determined to be the printing starting position (Ps) obtained from the single scan of print data. The set distance corresponding to 20 pulses is a quantity that corresponds to the distance from the printing starting position to a line X in FIG. 5.

As summarized, taking into consideration a range (corresponding to a length of 120 dots from the left end (T) of the printable range in this embodiment) where there is a great amount of deviation immediately after starting movement of the carriage as described above, if actual printing starts after the range, scanning of the carriage starts from a point (V2, V3) where is 120 dots leftward away from the left end of the preliminary running length. Thus, compared to a case where the scanning of the carriage for all lines starts from the left end of movable range of the carriage, overall printing speed is improved with suppressing the positional shift of printing.

Further, in a case where actual printing starts within a range between the left end of the printable range and a point where is 120 dots rightward away from the left end of the printable range in this embodiment, since there is a great amount of deviation in this range, a distance between a scanning starting point and a print starting point in each line greatly varies. Thus, an amount of deviation in each line becomes noticeable since a phase in a curve indicating cumulative amount of deviation for a line (as shown in FIG. 5) differs from that for a subsequent line. For this reason, in this embodiment, if actual printing starts within the above range, starting point of movement of the carriage is fixed to be the left end of movable range of the carriage so that the phase of the variation of the amount of deviation is the same_over lines. As a result, positional shifts in printing over lines are suppressed.

If staircase ruled lines of the kind shown in FIG. 6, for example, are printed, the above-described processing is such that the position at which the carriage starts moving becomes S (=V1) on the first to fourth lines of print scanning, and V2, V3, which are offset from S4, S5, respectively, by the distance corresponding to 20 driving pulses with regard to the fifth and sixth lines of print scanning, respectively.

Next, at step S50 in FIG. 7, printing is performed by moving the carriage from the position decided at step S30 or S40. By performing printing in this fashion, no deviation in the connections of the ruled lines occurs with regard to the first to fourth lines of print scanning. Further, in regard to the fifth and sixth lines of print scanning, an extra distance equivalent to 20 pulses is provided and, hence, no printing takes place in an area in which printing precision is poor immediately following start-up of the carriage motor. As a result, any deviation in the connections of the ruled lines is suppressed.

Finally, at step S60, it in determined whether printing has been completed. If it is judged here that all printing has not been completed, control returns to step S10 and processing for the next scan is executed. On the other hand, if it is judged that printing is completed, processing is exited.

Thus, in accordance with the processing described above, the position at which the carriage is started is set to a fixed range of the end of the printable range. Outside this range there is provided an area for moving the carriage preliminarily after start-up of the carriage. As a result, a deviation in printed dots in each printing scan can be kept small to make possible the formation of a high-definition image.

Further, according to this embodiment, parts such as an encoder or high-resolution motor are unnecessary and, hence, there is no increase in cost ascribable to such parts. In addition, there i s no increase in the size of the apparatus because the preliminary running length of the carriage at start-up of the motor at the end of the printable range is not enlarged.

In regard to the extra carriage running length added on after the carriage motor starts up, the pulses for moving the carriage preliminarily are applied after the carriage has attained sufficient speed. As a consequence, travel time due to these pulses is short and any effect it has upon the throughput of the overall printing operation can be kept very small.

Furthermore, control in this embodiment involves only setting the carriage movement starting point based upon recognition of the printing starting point or movement of the carriage movement starting point associated with the preliminary running length of the carriage. This means that the image can be improved by simple control.

In the case described above, printing is performed from the left edge toward the right edge of the printing sheets P. However, it goes without saying that similar control is possible also in a case where printing is performed from the right edge to the left edge, i.e., in the opposite direction.

In the case where the printing starting position is moved upon adding Qn the preliminary running length of the carriage in the above-described embodiment, an arrangement may be adopted in which these amounts of movement are stored in table form as the values of pulse counts (e.g., 56 pulses) applied to the stepping motor. It may be so arranged that independent tables are provided, one for movement of the carriage in a forward direction and one for movement of the carriage in the backward direction. In addition, not only pulse counts but also values of current applied to the stepping motor may be set in the table to provide even finer control. This will make it possible to reduce even further the deviation in printed dots immediately after the carriage motor is started up and, hence, to form an image of even higher definition.

[Other Embodiment]

Control set forth in the above-described embodiment will now be described with regard to an example in which a printing mode is used upon being selected from a variety of printing modes.

In this embodiment, the printing apparatus illustrated in FIGS. 1 to 4 is equipped with various printing modes for exchangeable printheads in the manner shown in FIG. 8. Printing is performed upon selecting the necessary printing mode from these modes.

FIG. 8 is a table showing the relationship between usable printheads and printing modes that can be supported by these printheads.

Each printhead in FIG. 8 is composed of 64 nozzles. In a monochrome printhead, all 64 of the nozzles discharge only black ink. A color printhead and a photographic printhead each have 16 nozzles for discharging Y (yellow) ink, 16 nozzles for discharging M (magenta) ink, 16 nozzles for discharging C (cyan) ink and 16 nozzles for discharging Bk (black) ink, and each of these nozzle groups is provided with a pitch of eight nozzles. Further, in the photographic printhead, use is made of inks obtained by diluting, at a fixed ratio, the inks employed in the color head. By printing these inks in superimposed form, it is possible to perform printing in which the gradation obtained is higher than that of the color printhead.

With regard to the printing modes, "HQ" represents a mode in which high-quality printing is performed by a single pass of printing; "Fine" is a mode in which printing image quality is raised by increasing the number of printing passes per line; "HS" denotes a high-speed printing mode; "Smoothing" represents a mode in which the expression particularly of inclined lines is raised by making the resolution 720 dpi; and "Photographic" is the mode described in which printing is carried out by superimposing inks. "Photographic" mode is used for printing a natural picture. The carriage speed in each mode is as shown in FIG. 8.

According to this embodiment, the control described in the foregoing embodiment is applied to the HQ and Fine (medium speed) modes when the color head is mounted. This is because in the HS printing mode, speed takes priority over the quality of the printed image. In the HQ printing mode using the monochrome printhead, the above-mentioned control is not applied because deviation of dots of a single color, namely black, is not easy to notice. With regard to the smoothing and photographic printing modes, carriage speed is slow and deviation of printed dots after start-up of the carriage motor is small. Even if the above-mentioned staircase ruled lines are printed, the deviation between neighboring dots at the time of each scan can be kept small, making it possible to form a high-definition image.

Thus, in accordance with this embodiment as described above, control described in the first embodiment is applied only to an effective printing mode selected from printing modes of a variety of types. This makes it possible to raise the performance of the overall printing apparatus.

In the foregoing embodiment, an example is described in which a distance corresponding to 20 driving pulses applied to the stepping motor is added onto the end of the printable range in order to stabilize carriage travel. However, this does not impose a limitation upon the present invention. It goes without saying that the distance can be changed depending upon the mechanical structure of the apparatus, the type of carriage motor and the driving conditions.

Further, in the above-described embodiments, an apparatus which prints by serial scanning is described. However, it is obvious that the present invention is applicable also to a printing apparatus which prints only when scanning is performed in one direction.

In the embodiments described above, the droplets discharged from the printhead are ink and the liquid contained in the ink tanks is ink. However, the liquids accommodated are not limited to ink. For example, the ink tanks may contain a processed liquid discharged onto the printing medium to enhance the fixation and water resistance of the image printed on the printing medium and to improve the quality of the image.

Each of the embodiments described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of so-called an on-demand type and a continuous type. Particularly, in the case of the on-demand type, the system is effective because, by applying at least one driving signal, which corresponds to printing information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Publication Laid-Open No. 59-123670 which discloses the arrangement using a slot common to a plurality of electrothermal transducers as a discharge portion of the electrothermal transducers, or Japanese Patent Publication Laid-Open No. 59-138461 which discloses the arrangement having an opening for absorbing a pressure wave of heat energy in correspondence with a discharge portion.

Furthermore, as a full line type printhead having a length corresponding to the width of a maximum printing medium which can be printed by the printer, either the arrangement which satisfies the full-line length by combining a plurality of printheads as disclosed in the above specification or the arrangement as a single printhead obtained by forming printheads integrally can be used.

In addition, not only a cartridge type printhead in which an ink tank is integrally arranged on the printhead itself but also an exchangeable chip type printhead, as described in the above embodiment, which can be electrically connected to the apparatus main unit and can receive an ink from the apparatus main unit upon being mounted on the apparatus main unit can be applicable to the present invention.

It is preferable to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention. In this case, an ink may be situated opposite electrothermal transducers while being held in a liquid or solid state in recess portions of a porous sheet or through holes, as described in Japanese Patent Publication Laid-Open Nos. 54-56847 or 60-71260. In the present invention, the above-mentioned film boiling system is most effective for the above-mentioned inks.

In addition, the ink-jet printer of the present invention may be used in the form of a copying machine combined with a reader, and the like, or a facsimile apparatus having a transmission/reception function in addition to an image output terminal of an information processing equipment such as a computer.

The present invention can be applied to a system constituted by a plurality of devices (e.g., host computer, interface, reader, printer) or to an apparatus comprising a single device (e.g., copy machine, facsimile).

Further, the object of the present invention can be also achieved by providing a storage medium storing program codes for performing the aforesaid processes to a system or an apparatus, reading the program codes with a computer (e.g., CPU, MPU) of the system or apparatus from the storage medium, then executing the program.

In this case, the program codes read from the storage medium realize the functions according to the embodiments, and the storage medium storing the program codes constitutes the invention.

Further, the storage medium, such as a floppy disk, a hard disk, an optical disk, a magneto-optical disk, CD-ROM, CD-R, a magnetic tape, a non-volatile type memory card, and ROM can be used for providing the program codes.

Furthermore, besides aforesaid functions according to the above embodiments are realized by executing the program codes which are read by a computer, the present invention includes a case where an OS (operating system) or the like working on the computer performs a part or entire processes in accordance with designations of the program codes and realizes functions according to the above embodiments.

Furthermore, the present invention also includes a case where, after the program codes read from the storage medium are written in a function expansion card which is inserted into the computer or in a memory provided in a function expansion unit which is connected to the computer, CPU or the like contained in the function expansion card or unit performs a part or entire process in accordance with designations of the program codes and realizes functions of the above embodiments.

As many apparently widely different embodiments of the present invention can be made without departing from the spirit and scope thereof, it is to be understood that the invention is not limited to the specific embodiments thereof except as defined in the appended claims.

What is claimed is:

1. A printing apparatus for forming an image on a printing medium by using a printhead comprising:

scanning means on which said printhead is mounted for scanning said printhead back and forth a first direction;

conveyance means for conveying the printing medium in a second direction that intersects the first direction;

input means for inputting print data;

decision means for deciding a printing starting position for each scan, on the basis of the print data that has been input from said input means;

discrimination means for discriminating whether or not the printing starting position decided by said decision means falls within a predetermined range;

setting means for, on the basis of the discrimination made by said discrimination means, setting a scanning starting position of said printhead scanned by said scanning means, to a position spaced a predetermined first distance away from one end of a printable range on the printing medium if the printing starting position has been determined to fall within the predetermined range, while setting the scanning starting position of said printhead to a position spaced a predetermined second distance away from the printing starting position if the printing starting position has been determined to fall outside the predetermined range; and printing means for performing printing by moving said printhead after said printhead has been moved to the position set by said setting means.

2. The apparatus according to claim 1, wherein said scanning means includes:

a carriage to which the printhead is mounted; and a carriage motor for generating a driving force that drives the carriage.

3. The apparatus according to claim 2, wherein said carriage motor is a stepping motor.

4. The apparatus according to claim 1, wherein said printhead can be removably attached to said scanning means; and said printhead can be selected from printheads of a plurality of types and removably attached to said scanning means.

5. The apparatus according to claim 4, wherein the printheads of the plurality of types include a printhead for monochrome printing, a printhead for color printing and a printhead for photographic printing.

6. The apparatus according to claim 4, wherein said printhead is an ink-jet printhead for printing by discharging ink.

7. The apparatus according to claim 6, wherein said printhead has an electrothermal transducer for generating thermal energy applied to ink in order to discharge the ink by utilizing the thermal energy.

8. The apparatus according to claim 4, wherein a plurality of selectable printing modes be provided for corresponding ones of the printheads of the plurality of types.

9. The apparatus according to claim 8, wherein said setting means is capable of operating with respect to a specific printing mode among the plurality of printing modes.

10. The apparatus according to claim 1, further comprising a table for setting the predetermined first and second distances.

11. A printing control method applied to a printing apparatus for forming an image on a printing medium by using a printhead and having a carriage on which the printhead is mounted for scanning the printhead back and forth in a predetermined direction, the method comprising:

an input step of inputting print data;

a decision step of deciding a printing starting position for each scan, based upon the print data that has been input at said input step;

a discrimination step of discriminating whether or not the printing starting position decided at said decision step falls within a predetermined range;

a setting step of, on the basis of the discrimination made at said discrimination step, setting a scanning starting position of the printhead scanned by the carriage, to a position spaced a predetermined first distance away from one end of a printable range on the printing medium if the printing starting position has been determined to fall within the predetermined range, while setting the scanning starting position of the printhead to a position spaced a predetermined second distance away from the printing starting position if the printing starting position has been determined to fall outside the predetermined range; and a printing step of performing printing by moving the carriage, on which printhead has been mounted, after the carriage has been moved to the position set at said setting step.

12. The method according to claim 11, wherein the predetermined range is determined from an amount of deviation in a printing position when scanning the printhead.

13. The apparatus according to claim 1, wherein the predetermined range is determined from an amount of deviation in a printing position when the printhead is scanned by said scanning means.

* * * * *

UNITED STATES PATENT AND TRADEMARK OFFICE

CERTIFICATE OF CORRECTION

PATENT NO. : 6,322,263 B1
DATED : November 27, 2001
INVENTOR(S) : Takeji Niikura It is certified that error appears in the above-identified patent and that said Letters Patent is hereby corrected as shown below:

Column 10,
Lines 24 and 32, "where" should read -- which --; and
Line 44, "same_over" should read -- same over --.

Column 11,
Line 13, "i s" should read -- is --.

Column 13,
Line 5, "so-called an" should read -- a so-called --.

Column 15,
Line 16, "a" should read -- in a --.

Column 16,
Line 11, "be" should read -- is --.

Signed and Sealed this

Twenty-first Day of May, 2002

*Attest:*

*Attesting Officer*

JAMES E. ROGAN
*Director of the United States Patent and Trademark Office*